US006613276B1

(12) United States Patent
Munir et al.

(10) Patent No.: US 6,613,276 B1
(45) Date of Patent: Sep. 2, 2003

(54) MICROALLOYING OF TRANSITION METAL SILICIDES BY MECHANICAL ACTIVATION AND FIELD-ACTIVATED REACTION

(75) Inventors: Zuhair A. Munir, Davis, CA (US); Joseph N. Woolman, Davis, CA (US); John J. Petrovic, Los Alamos, NM (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/124,633

(22) Filed: Apr. 16, 2002

(51) Int. Cl.[7] ..... B22F 3/12; C22C 1/04

(52) U.S. Cl. ..... 420/580; 420/590; 419/32; 419/45

(58) Field of Search ..... 419/32, 46, 45; 420/580, 590

(56) References Cited

U.S. PATENT DOCUMENTS

| | | | | |
|---|---|---|---|---|
| 4,927,792 | A | 5/1990 | Petrovic et al. | |
| 4,970,179 | A | 11/1990 | Petrovic et al. | |
| 5,000,896 | A | 3/1991 | Petrovic et al. | |
| 5,063,182 | A | 11/1991 | Petrovic et al. | |
| 5,064,789 | A | 11/1991 | Petrovic et al. | |
| 5,069,841 | A | 12/1991 | Petrovic et al. | |
| 5,380,409 | A | 1/1995 | Munir et al. | |
| 5,382,553 | A | 1/1995 | Petrovic | |
| 5,454,999 | A | * 10/1995 | Jayashankar et al. | 419/32 |
| 5,887,241 | A | * 3/1999 | Jayashankar et al. | 419/14 |
| 5,928,583 | A | 7/1999 | McClellan et al. | |
| 6,136,452 | A | 10/2000 | Munir et al. | |
| 6,197,247 | B1 | 3/2001 | Rodriguez et al. | |
| 6,200,515 | B1 | 3/2001 | Munir et al. | |
| 6,211,496 | B1 | 4/2001 | Uchiyama et al. | |
| 6,300,265 | B1 | 10/2001 | Rodriguez et al. | |

OTHER PUBLICATIONS

Carrillo–Heiam, E.M. et al. "Simultaneous synthesis and densification of niobium silicide/niobium composites," *Scripta Meterialia* 2001, pp. 405–412, vol. 45.

Gibala, R. et al. "Plasticity enhancement mechanisms in $MOSi_2$," *Materials Sci. & Engineering* 1999, pp. 122–130, vol. A261.

Ito, K. et al. "Plastic deformation of $MoSi_2$ single crystals," *Phylisophical Magazine A* 1995, pp. 1075–1097, vol. 72, No. 4.

Klassen, T. et al. "Ball milling of systems with positive heat of mixing: Effect of temperature in Ag–Cu," *Acta mater.* 1997, pp. 2921–2930, vol. 45, No. 7.

Maloy, S.A. et al. "On the slip systems in $MoSi_2$," *Acta metal mater.* 1992, pp. 3159–3165, vol. 40, No. 11.

Maloy, S.A. et al. "High temperature plastic anisiotropy in $MOSi_2$ single crystals," *Acta metal. mater.* 1995 pp. 657–668, vol. 43, No. 2, (List continued on next page.)

*Primary Examiner*—Daniel Jenkins
(74) *Attorney, Agent, or Firm*—M. Henry Heines; Townsend and Townsend and Crew LLP

(57) ABSTRACT

Alloys of transition metal suicides that contain one or more alloying elements are fabricated by a two-stage process involving mechanical activation as the first stage and densification and field-activated reaction as the second stage. Mechanical activation, preferably performed by high-energy planetary milling, results in the incorporation of atoms of the alloying element(s) into the crystal lattice of the transition metal, while the densification and field-activated reaction, preferably performed by spark plasma sintering, result in the formation of the alloyed transition metal silicide. Among the many advantages of the process are its ability to accommodate materials that are incompatible in other alloying methods.

24 Claims, 14 Drawing Sheets

OTHER PUBLICATIONS

Orrú, R. et al. "Synthesis of dense nanometric $MoSi_2$ through mechanical and field activation," *J. Mater. Res.* May 2001, pp. 1439–1448, vol. 16, No. 5.
Petrovic, J.J. and Honnell, R.E. "SiC reinforced–$MoSi_2$/$WSi_2$ alloy matrix composites," *Ceram. Eng. Sci. Proc.* 1990 pp. 734–744, vol. 11, No. 7–8.
Petrovic, J.J. "Toughening strategies for MO–$Si_2$–based high temperature structural silicides," *Intermetallics* 2000, pp. 1175–1182, vol. 8.
Sadananda, K, and Feng, C.R. "Effect of carbon addition on the creep of molybdenum disilicide composities," *Materials Sci. & Enginneering* 1995, pp. 862–867, vol. A192/193.
Shah, D. M. et al. "Appraisal of other silicides as structural materials," *Materials Sci. & Engineering* 1992, pp. 45–57, vol. A155.
Umakoshi, Y. et al. "High temperature deformation of $MoSi_2$ single crystals with the $C11_b$ structure," *Acta metall. mater.* 1990, pp. 909–915, vol. 38, No. 6.
Waghmare, U.V. et al. "Microalloying for ductility in molybdenum disilicide," *Materials Sci. & Engineering* 1999, pp. 147–157, vol. A261.
Wang, S. W. et al. "Densification of Al2O3 powder using spark plasma sintering," *J. Mater. Res.* Apr. 2000, pp. 982–987, vol. 15, No. 4.

* cited by examiner

MICROALLOYING OF TRANSITION METAL SILICIDES BY MECHANICAL ACTIVATION AND FIELD-ACTIVATED REACTION

STATEMENT AS TO RIGHTS TO INVENTIONS MADE UNDER FEDERALLY SPONSORED RESEARCH OR DEVELOPMENT

This invention was made with government support under Grant No. DAAD19-01-1-0493, awarded by the United States Army. The Federal Government has certain rights in this invention.

BACKGROUND OF THE INVENTION

1. Field of the Invention

This invention resides in the field of transition metal suicides and methods for enhancing the low-temperature ductility of these materials.

2. Description of the Prior Art

Silicides of transition metals are useful structural materials for electronic devices where they are used as contacts and interconnects, and for larger scale equipment intended for use in oxidizing environments at high temperatures. Examples of non-electronic devices in which transition metal silicides are used are furnace heating elements, molten metal lances, industrial gas burners, aerospace turbine engine components, diesel engine glow plugs, and glass processing equipment. Molybdenum disilicide is of particular interest among transition metal silicides due to its high melting point, low density, high oxidation resistance, high thermal and electrical conductivity, and compatibility with ceramic reinforcement phases, although other transition metal silicides have similar properties.

Despite their beneficial features, the usefulness of transition metal suicides is limited by their low ductility (lack of fracture toughness) at low temperatures, their low strength at high temperatures, and a tendency toward pesting, i.e., a disintegration into powder that is thought to be the result of accelerated oxidation. Fracture toughness at low temperatures is a particular problem. The low-temperature fracture toughness of using molybdenum silicide, for example, 3 $MPa \cdot m^{1/2}$ as compared to a required minimum of about 10 $MPa \cdot m^{1/2}$ for industrial applications and about 15–20 $MPa \cdot M^{1/2}$ for turbines. The low fracture toughness also makes molybdenum disilicide difficult to machine, and effective machining is achievable only by the costly method of electro-discharge machining.

Attempts to enhance the plasticity and thereby improve the fracture toughness of molybdenum disilicide and other transition metal silicides have included pre-straining of the material at high temperature, applying surface coatings (an example of which is zirconia), and forming composites by the inclusion of a second phase such as ceramic and metallic fibers or particles. Some of these methods are disclosed by Petrovic, J. J., "Toughening Strategies for $MoSi_2$-Based High Temperature Structural Silicides," *Intermelallics* 8: 1175–1182 (2000), and Gibala, R., et al., "Plasticity Enhancement Mechanisms in $MoSi_2$," *Mater. Sci. Eng.* A261:122–130 (1999). All literature and patent citations throughout this specification are incorporated herein by reference.

While composites may improve the fracture toughness, the synthesis and processing of composites are often difficult and expensive. An alternative is the formation of alloys by the incorporation of alloying elements. A variety of alloying elements have been proposed, including elements that serve as substitutes on the transition metal sub-lattice and those that serve as substitutes on the silicon sub-lattice. The most promising alloying element to date, in view of its high disembrittlement parameter, is magnesium, according to the studies of Waghmare, U.V., et al., as reported in "Microalloying for Ductility in Molybdenum Disilicide," *Mater. Sci. Engin.* A261: 147–157 (1999). Magnesium has a high volatility, however, which renders conventional alloying methods such as arc melting unsuitable.

SUMMARY OF THE INVENTION

It has now been discovered that a transition metal silicide alloy containing one or more alloying elements that provide the alloy with a greater fracture toughness than that of the transition metal silicide itself can be formed by combining elemental powders of the metals into a mixture and subjecting the mixture to mechanical activation followed by densification and field-activated reaction. The mechanical activation is achieved by milling and causes the alloying element to chemically combine with the transition metal by incorporation into the transition metal crystal structure. The densification and field-activated reaction are then performed by applying a compressive force to the transition metal (with the alloying element incorporated therein) and the silicon while exposing the materials to an electric current at a sufficient intensity and for a sufficient time to cause formation of the transition metal silicide in a crystal lattice that incorporates the alloying element into the lattice structure.

The method of the present invention minimizes the presence of secondary phases and produces an alloy whose microstructure consists mostly if not entirely of a single crystalline phase. These and other features, objects and advantages of the invention are explained in detail below.

DETAILED DESCRIPTION OF THE INVENTION AND PREFERRED EMBODIMENTS

Figure 1A:
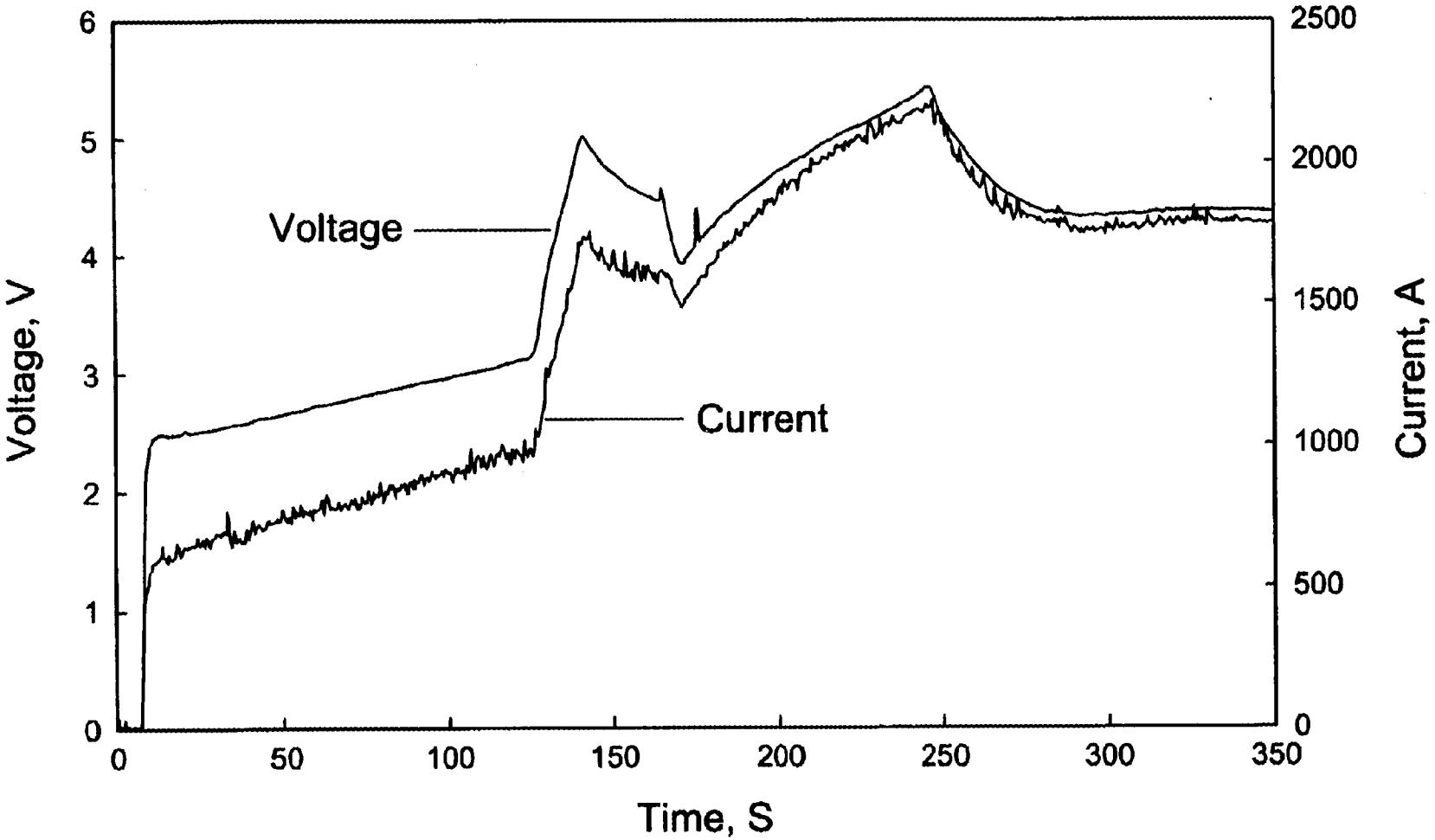
FIG. 1*a* is included for purposes of comparison and is a plot of voltage vs. time and current vs. time for a spark plasma sintering (SPS) process on a molybdenum, silicon, and magnesium powder mixture that has not been mechanically activated.

The silicides into which the alloying element is incorporated in accordance with this invention are transition metal silicides in general, although certain transition metals are preferred. These preferred metals are titanium, vanadium, chromium, yttrium, zirconium, niobium, molybdenum, tantalum, and tungsten. Among these, the more preferred are titanium, vanadium, chromium, niobium, molybdenum, and tantalum. Examples of transition metal silicides are tungsten disilicide ($WSi_2$), pentatungsten trisilicide ($W_5Si_3$), niobium disilicide ($NbSi_2$), pentaniobium trisilicide ($Nb_5Si_3$), tantalum disilicide ($TaSi_2$), pentatantalum trisilicide ($Ta_5Si_3$), molydenum disilicide ($MoSi_2$), pentamolybdenum trisilicide ($Mo_5Si_3$), titanium disilicide ($TiSi_2$), pentatitanium trisilicide ($Ti_5Si_3$), chromium disilicide ($CrSi_2$), zirconium disilicide ($ZrSi_2$), yttrium disilicide ($YSi_2$), and vanadium disilicide ($VSi_2$). Molybdenum disilicide is of greatest current interest due to its prominence in the industry and in the published literature describing these materials and their use. While trisilicides and in general various ratios of the transition metal to silicon can be formed, the preferred silicides are the disilicides, and thus the preferred atomic ratio of silicon to transition metal is approximately 2:1. The preferred silicide crystal structure is the tetragonal structure.

Alloying elements suitable for use in the practice of this invention include alloying elements that substitute for the transition metal in the transition metal silicide lattice as well as alloying elements that substitute for the silicon in the transition metal silicide lattice. Included among the possible alloying elements that substitute for the transition metal are other transition metals, notably rhenium, niobium, tantalum, chromium, zirconium, and vanadium. When a transition metal serves as an alloying element, it will be a different transition metal than the.base transition metal of the transition metal silicide. Preferred transition metal alloying elements are rhenium, niobium, and vanadium. Included among the possible alloying elements that substitute for silicon are aluminum and magnesium, of which magnesium is preferred. Transition metals as alloying elements are distinguishable from base transition metals by their amounts in the alloy. The base transition metal will constitute the majority of the metal content of the alloy by either weight or atomic percent while the alloying transition metal will be present only in an alloying amount.

Since the preferred atomic ratio of silicon to transition metal in the base compound is 2:1, this means that when the alloying element is one that substitutes for the base transition metal, the ratio of the silicon to the total of the base transition metal and the alloying element is approximately 2:1. Likewise, when the alloying element is one that substitutes for the silicon, the ratio of the total of the alloying element and silicon to the base transition metal is approximately 2:1. In the powder mixture that is used as a starting material, the amounts of each component are selected to achieve this ratio, in accordance with the type of alloying element used. For example, when the alloying element is magnesium, the starting powder mixture in preferred embodiments of this invention is one in which the atomic ratio of (i) magnesium and silicon to (ii) transition metal is from about 1.9:1 to about 2.1:1, and more preferably from about 1.95:1 to about 2.05:1. Likewise, when the alloying element is rhenium, the starting powder mixture in preferred embodiments of this invention is one in which the atomic ratio of (i) silicon to (ii) rhenium and the base transition metal is from about 1.9:1 to about 2.1:1, and more preferably from about 1.95:1 to about 2.05:1.

This invention also extends to alloys incorporating more than one alloying element. For example, two alloying elements may be present that substitute for the silicon, or two that substitute for the transition metal, or one that substitutes for the silicon and another that substitutes for the transition metal, or two that substitute for the silicon and one that substitutes for the transition metal. Examples of such combinations are Mg—Al, Mg—Nb, and Mg—Al—Nb. When any of these combinations of alloying elements is used, the ratio ranges for preferred embodiments of the invention are based on the combinations that are determined by the base element that each alloying element substitutes for, and are the same as those cited above.

Each alloying element is present in an "alloying amount," which term is used herein to denote a level that is high enough relative to the transition metal silicide that the alloying element renders the transition metal silicide more ductile without imposing a major detriment to the desirable physico-chemical properties of the transition metal silicide, i.e., the high melting point, low density, and high oxidation resistance of the transition metal silicide. The amount of alloying element may vary, although best results will be obtained when the alloying element constitutes from about 0.5% to about 25% of the entire powder mixture on an atomic basis, preferably from about 1% to about 15%, and most preferably from about 3% to about 10%.

The starting material for the synthesis is a mixture of high-purity elemental powders of the different elements, preferably consisting of particles of about 100 microns or less in diameter. The mixture is prepared by mixing the powders to achieve a substantially uniform distribution of each element through the mixture. Such mixing is readily achieved by the use of conventional powder mixers that are readily available from commercial suppliers.

The chemical combination of the metals in accordance with this invention is begun with "mechanical activation," a term which is used herein to denote subjecting the powder mixture to mechanical impact of sufficiently high energy and for a sufficient length of time to combine the different elements into a crystal lattice. In this invention, the mechanical activation results in the formation of a solid solution. The resulting crystalline phase may or may not be the same as that of the ultimate product, since phase transitions may occur in the densification and field-activated reaction step to follow. Nevertheless, a crystalline lattice containing both the transition metal and the alloying element is indeed formed during the mechanical activation stage of the process, and in preferred embodiments of this invention all or substantially all of the alloying element is incorporated into the transition metal at this stage.

Mechanical activation can be achieved by the use of conventional high-energy impact milling equipment. Centrifugal or planetary mills are examples of such equipment. Such mills apply centrifugal and/or planetary action to the powder mixture with the assistance of grinding balls, providing acceleration of up to 20 g to grind the powder down to colloidal size (1 micron or less). The milling conditions, including the sizes of the milling balls, the quantity of milling balls relative to the amount of powder, the rotation speed of the planetary mill, the temperature at which the milling is performed, and the duration of the process, can vary widely. One of the parameters that may affect the result is the "charge ratio," which is defined as the ratio of the mass of the milling balls to the mass of the powder. In preferred embodiments of this invention, a charge ratio of from about 10 to about 20 is used, and in the most preferred embodiments the ratio is from about 12 to about 16.

Densification and field-activated reaction are then achieved by compressing the powder mixture while passing an electric current through the mixture. The term "field-activated reaction" is used herein to mean the passing of an electric current through the mixture at a sufficient intensity to achieve a reaction between the elements present in the mixture that will incorporate the various elements into a crystalline lattice. Densification and field-activated reaction in the practice of this invention result in the formation of a dense transition metal silicide crystal structure with the alloying element incorporated into the structure as part of either the silicon sub-lattice or the transition metal sub-lattice, depending on the choice of alloying element. Densification and field-activated reaction are achieved by placing the mechanically activated powder mixture in a press and passing an electric current through the powder mixture as it is being compressed, preferably under subatmospheric pressure.

A preferred process for passing an electric current through the powder mixture is spark plasma sintering, in which a pulsewise DC electric current is applied to heat the powder while pressure is being applied. Spark plasma sintering and other forms of sintering involving both pressure and the application of an electric current are known in the art. A description of such methods and the apparatus in which these methods are applied is presented by Wang, S. W., et al., "Densification of $Al_2O_3$ powder using spark plasma sintering," *J. Mater. Res.* 15(4), 982–987 (2000), which as noted above is incorporated herein by reference. While the conditions may vary, best results will generally be obtained with a densification pressure of from about 10 MPa to about 200 MPa, preferably from about 40 MPa to about 100 MPa. Likewise, the preferred current is a pulsed DC electric current of from about 1,000 A to about 10,000 A, most preferably from about 1,500 A to about 5,000 A. Preferred temperatures are within the range of from about 900° C. to about 2,000° C., and most preferably from about 1,000° C. to about 2,000° C. An inert gas is typically used for densification to achieve isostatic compression, and preferred gas pressures are within the range of from about 0.01 Torr to about 10 Torr, and most preferably from about 0.03 Torr to about 1.0 Torr.

The following example is offered for purposes of illustration and is not intended to limit the scope of the invention.

EXAMPLE

Elemental powders of silicon, molybdenum and magnesium were combined to form a powder mixture. The powders of each of the metals were sized to a sieve classification of −325 mesh, i.e., less than 44 microns in size. The silicon and molybdenum powders were 99.999% pure and the magnesium powder was 99.8% pure. The powders were mixed in proportions to yield a nominal Mo:Si atomic ratio of 1:2 adjusted by the substitution of magnesium for a portion of the silicon. The amount of magnesium used was 6.67% of the entire mixture on an atomic basis. The relative amounts were therefore 1 part of molybdenum to 1.8 parts of silicon to 0.2 part of magnesium, all on an atomic basis. The actual amounts used were accurate to three decimal places.

The elemental powders were mixed for one hour on a mechanical shaker-mixer (a system Schatz TURBULA® mill, Willy A. Bachofen AG Maschinenfabrik, Basel, Switzerland) using glass vials and alumina balls. Mechanical activation of the powder mixture was then achieved by adding 10 mm diameter cerium-stabilized zirconia milling balls to the powder mixture at a charge ratio (i.e., the mass ratio of milling balls to powder) of 14, and placing the balls and powder mixture in ceria-stabilized zirconia milling jars. The jars and their contents were placed under an argon atmosphere, and the jars were sealed and placed on a Fritsch Pulverisette 5 Planetary Mill (Fritsch GmbH, Dusseldorf, Germany), where the powder was milled at a rotation speed of 250 rpm in cycles of 5 minutes on and 10 minutes off over a period of 24 hours, amounting to 8 hours of total milling time.

The powders milled on the planetary mill were analyzed in a Scintag XDS-2000 Powder Diffractometer (ARL-Scintag, Inc., Ecublens, Switzerland) using CuKα radiation (λ=1.5405 Å), an Ni filter, and a step scan from 20–138° with a counting time of 4.2 seconds per step. The powders were then reacted and sintered in a spark plasma sintering (SPS) apparatus (Model SPS-1050, Sumitomo Heavy Industries, Tokyo, Japan), consisting of a water-cooled 100 kN press with graphite dies, combined with a 15 V, 5000 A pulsed DC power supply. The samples treated were 8 g in weight, and the apparatus was run by applying a uniaxial force of 18 kN (63.2 MPa) and an electric pulse cycle of 12 msec on and 2 msec off, under an absolute pressure of 0.1 Torr. Temperature control was achieved by an optical pyrometer with feedback control. The temperature of the sample rose to 600° C. in two minutes, and then to 1200° C. in two additional minutes. The sample was held at 1200° C. for four minutes. The same SPS treatment was applied to powders that had not been mechanically activated.

Figure 1B:
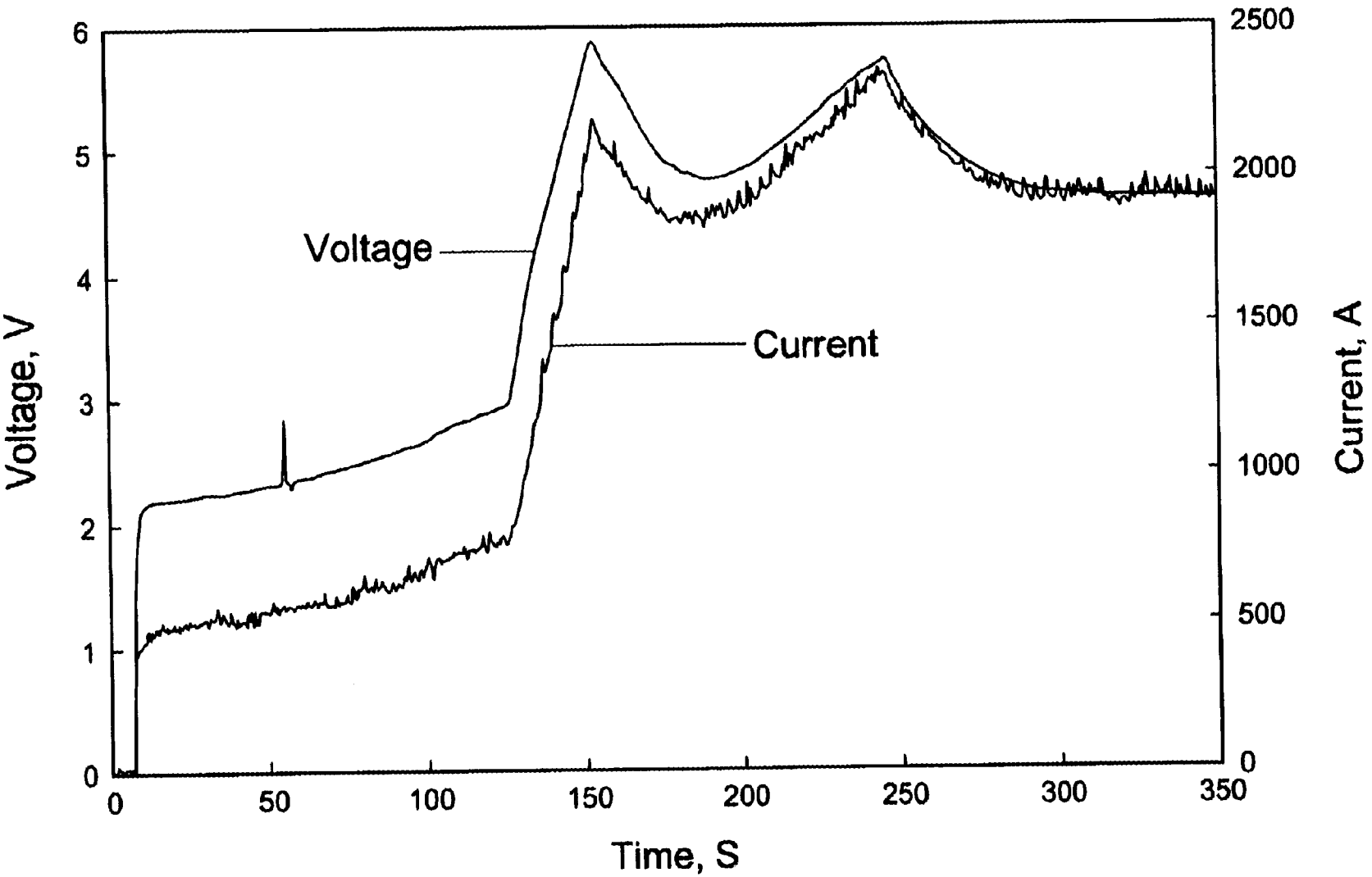
FIG. 1*b* illustrates an embodiment of the present invention and is a plot of voltage vs. time and current vs. time for an SPS process on a mechanically activated powder mixture of molybdenum, silicon, and magnesium.
Figure 2A:
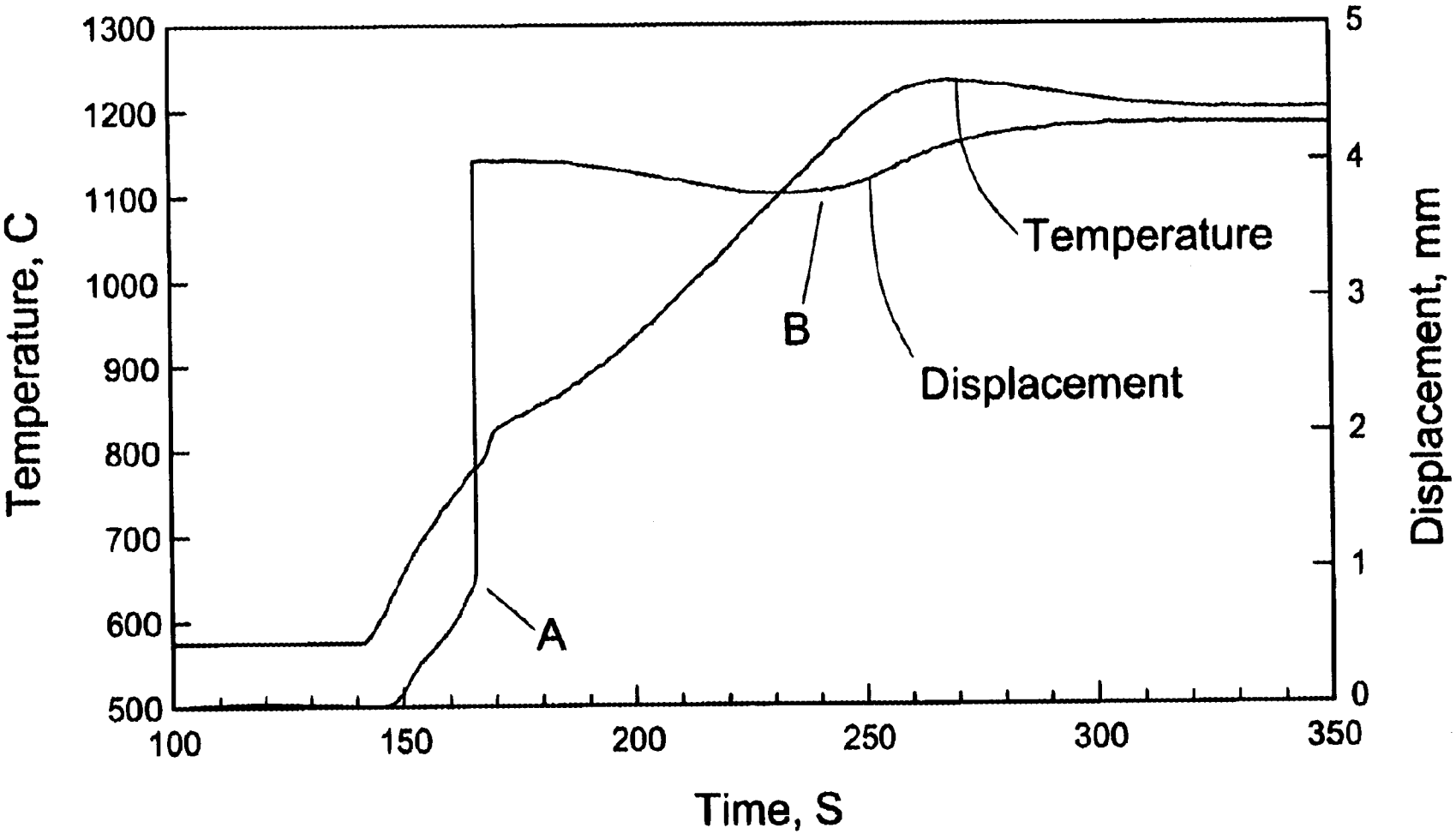
FIG. 2*a*, included for purposes of comparison, is a plot of temperature vs. time and displacement vs. time for an SPS process on a molybdenum, silicon, and magnesium powder mixture that has not been mechanically activated.
Figure 2B:
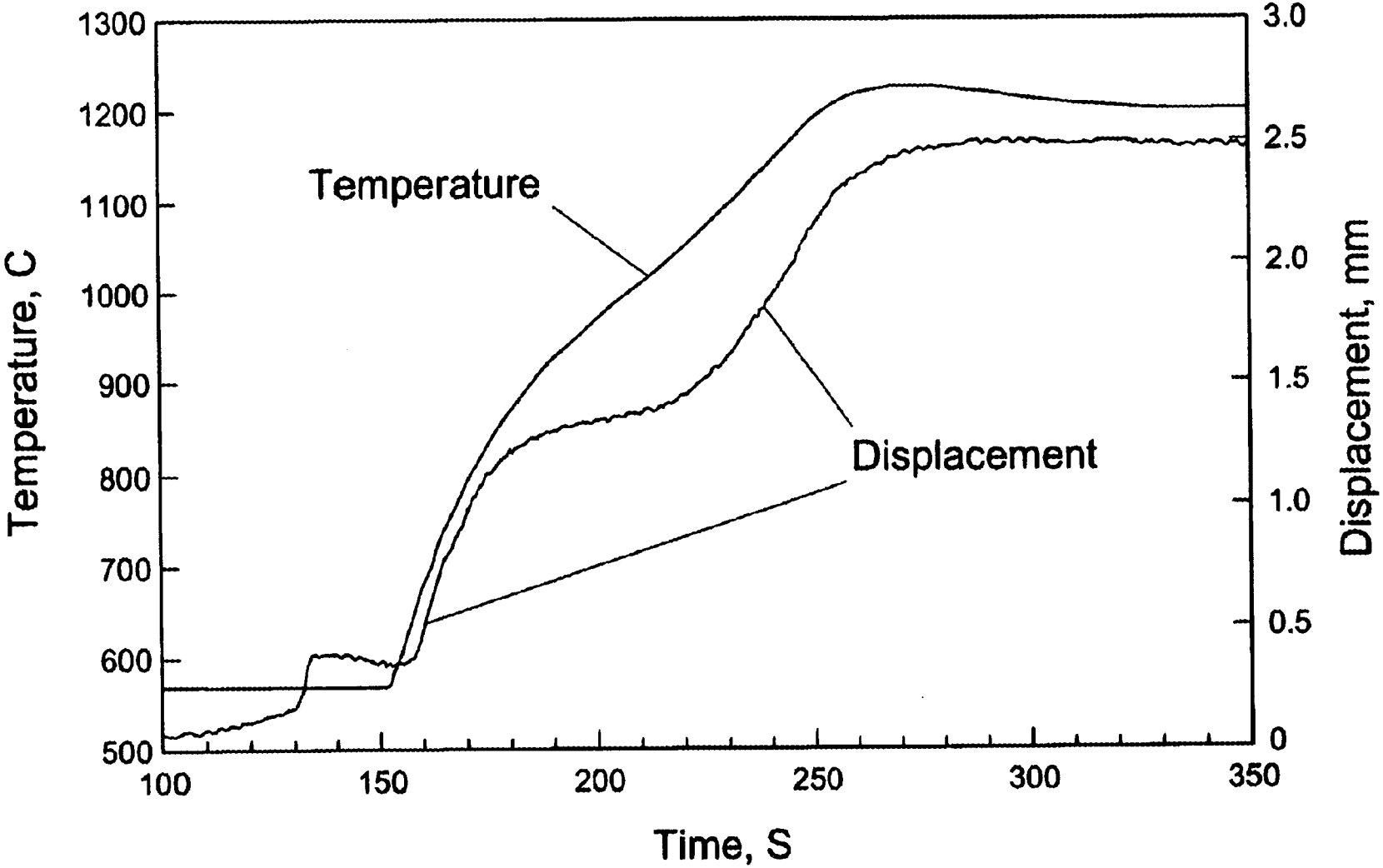
FIG. 2*b*, illustrating an embodiment of the present invention, is a plot of temperature vs. time and displacement vs. time for an SPS process on a mechanically activated powder mixture of molybdenum, silicon, and magnesium.

The voltage vs. time and current vs. time profiles during the SPS procedure of the samples that had not been mechanically activated are shown in FIG. 1*a*, while those of the samples that had been mechanically activated are shown in FIG. 1*b*. For the non-mechanically activated samples, the maximum current was 2,200 A and the maximum voltage was 5.4 V. For the mechanically activated samples, the maximum current was 2,300 A and the maximum voltage was 5.8 V. Plots of the temperature vs. time and displacement (shrinkage) vs. time during the SPS procedure are shown in FIG. 2*a* for the samples that had not been mechanically activated and in FIG. 2*b* for the mechanically activated samples. For the samples that had not been mechanically activated (FIG. 2*a*), displacement occurred in two stages. The first was less than 0.8 mm and was gradual over time, while the second occurred at 165 seconds and a temperature of 650° C. and was more abrupt (up to 4 mm), possibly due to the melting of magnesium. The plot then shows a slight expansion, possibly due to boiling off of magnesium. By comparison, the displacement in the activated samples (FIG. 2*b*) was a smooth curve with no abrupt changes, essentially following the pattern of the temperature profile.

The SPS-treated samples were analyzed for evidence of Mg incorporation using x-ray diffraction (XRD), energy dispersive spectroscopy (EDS), and electron energy-loss spectroscopy (EELS). Analyses were also performed on powders that had been mixed but not mechanically activated, powders that had been mechanically activated but not subjected to SPS, and powders that had been subjected to SPS without mechanical activation.

X-Ray Diffraction Analyses

Figure 3:
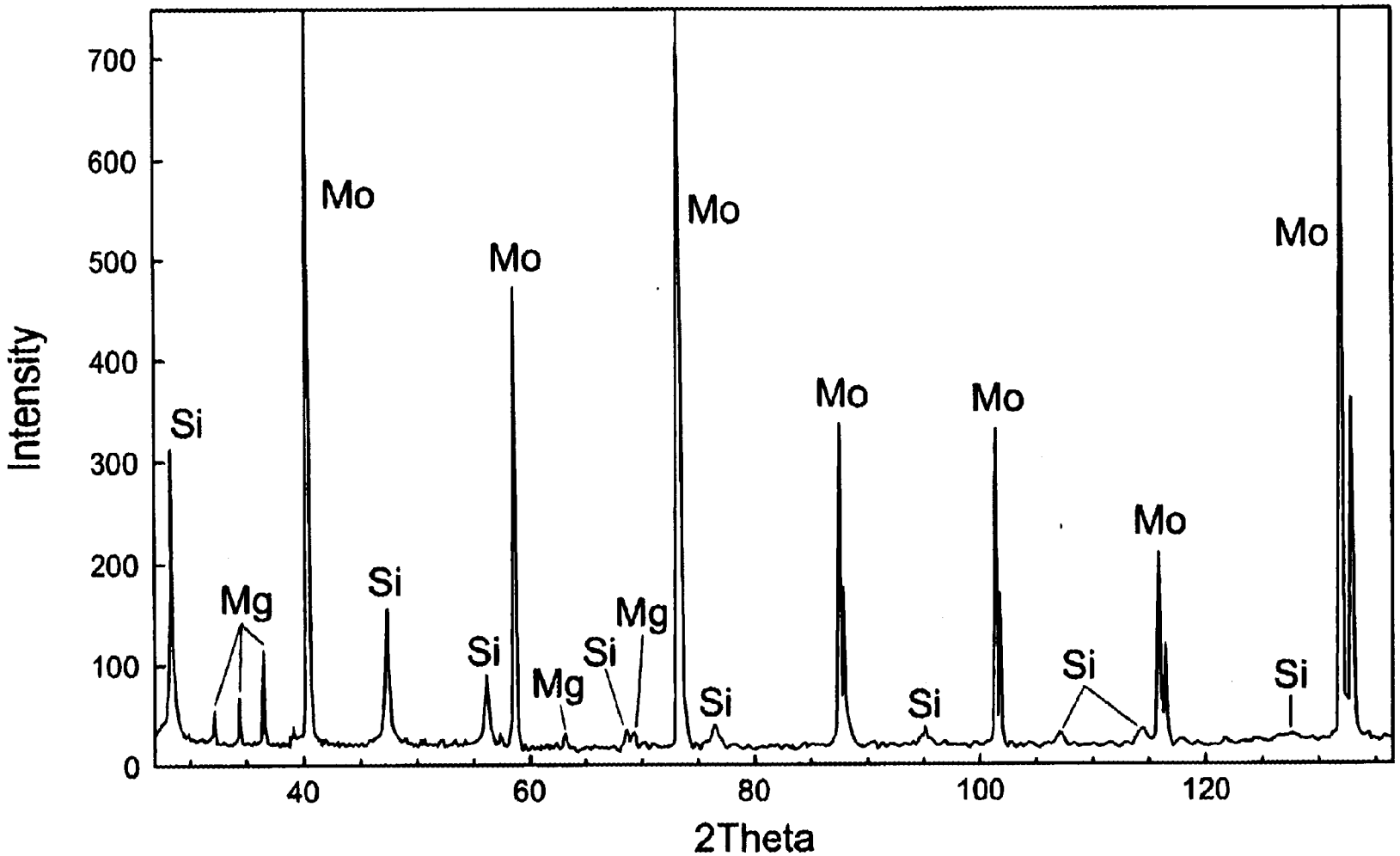
FIG. 3, included for purposes of comparison, is an x-ray diffraction pattern of a molybdenum, silicon, and magnesium powder mixture that has been neither mechanically activated nor subjected to SPS.

The XRD patterns are shown in FIGS. 3, 4, 5*a*, 5*b*, 5*c*, 6*a*, 6*b*, and 6*c* as follows:

FIG. 3: mixed but neither mechanically activated nor subjected to SPS

Figure 4:
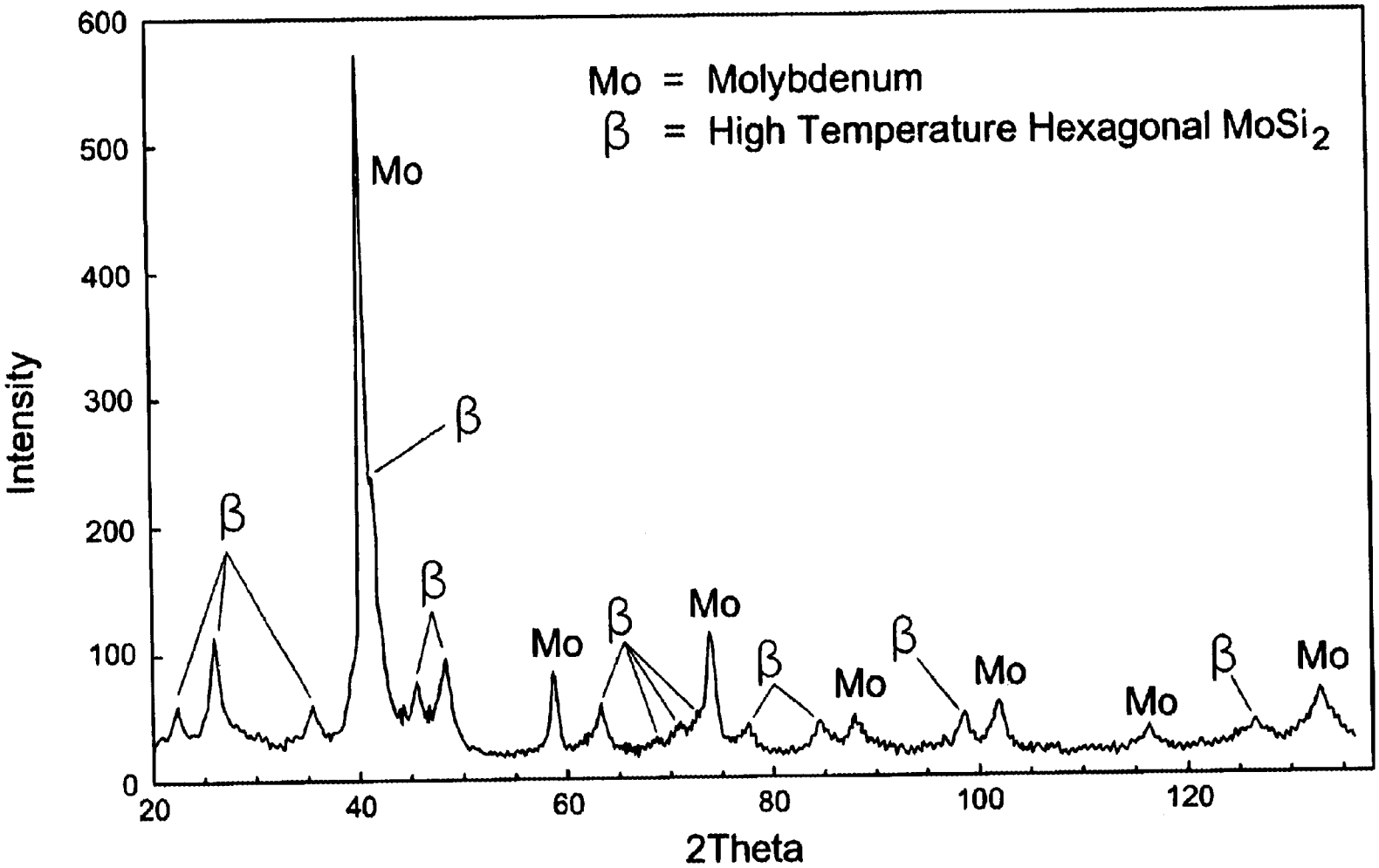
FIG. 4, included for purposes of comparison, is an x-ray diffraction pattern of a molybdenum, silicon, and magnesium powder mixture after mechanical activation but prior to SPS.

FIG. 4: mixed and mechanically activated but not subjected to SPS

Figure 5A:
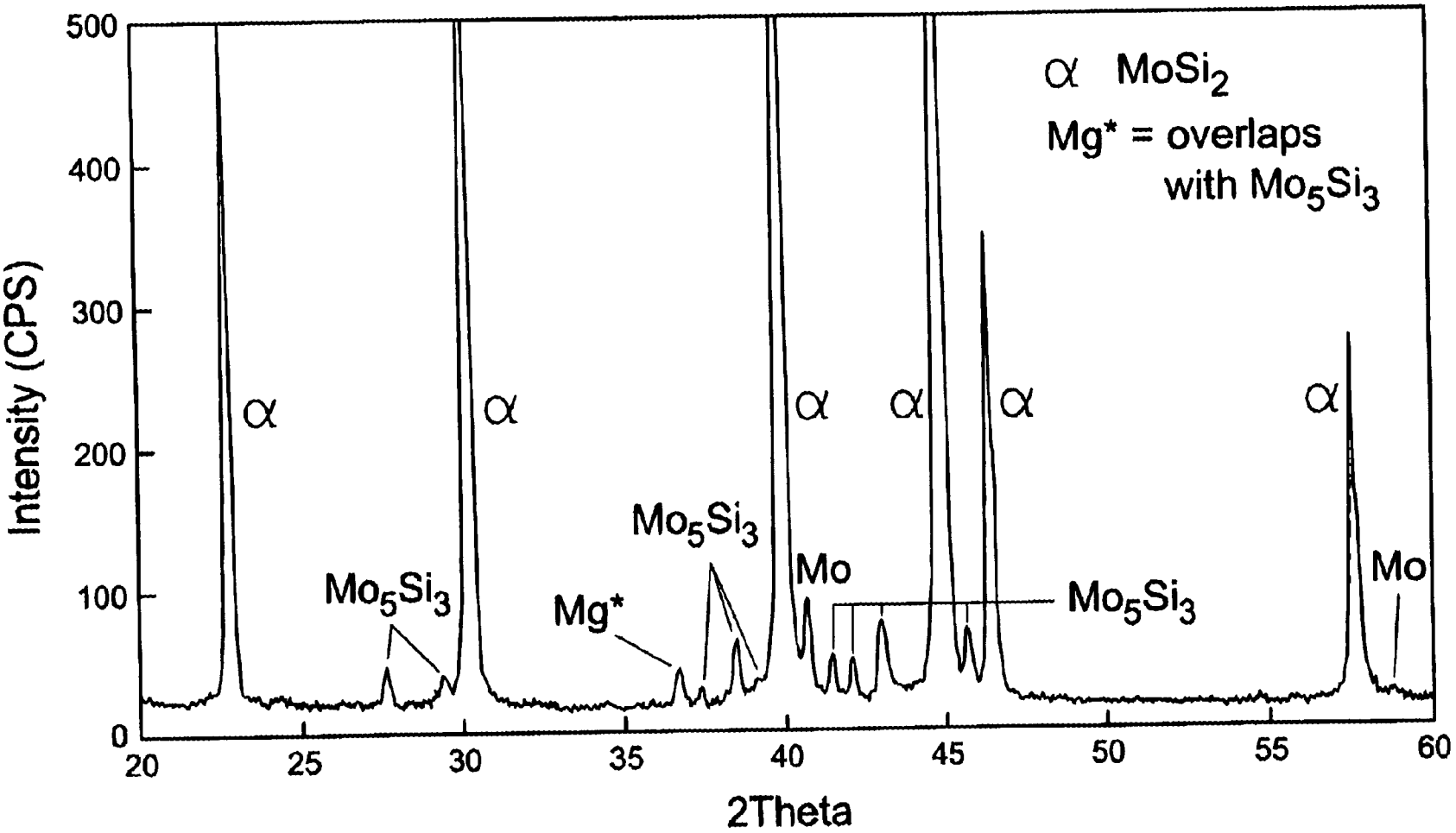
FIGS. 5*a* and 5*b*, included for purposes of comparison, are $2\theta=20–60°$ and $2\theta=60–138°$ portions, respectively, of an x-ray diffraction pattern of a molybdenum, silicon, and magnesium powder mixture after SPS but without prior mechanical activation.

FIG. 5*a*: mixed and subjected to SPS without mechanical activation, showing 2θ range of 20–60°

Figure 5B:
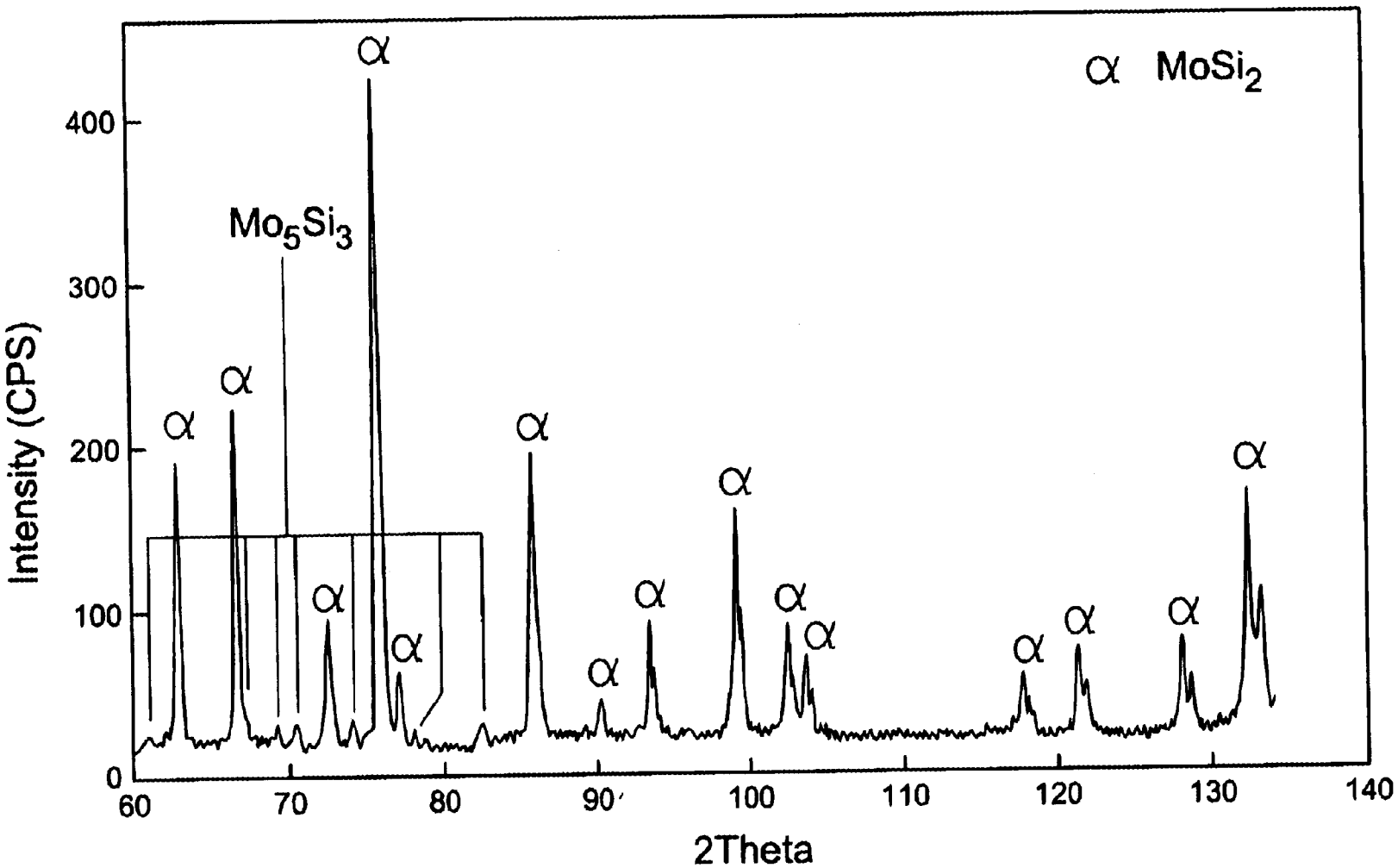

FIG. 5*b*: mixed and subjected to SPS without mechanical activation, showing 2θ range of 60–138°

Figure 5C:
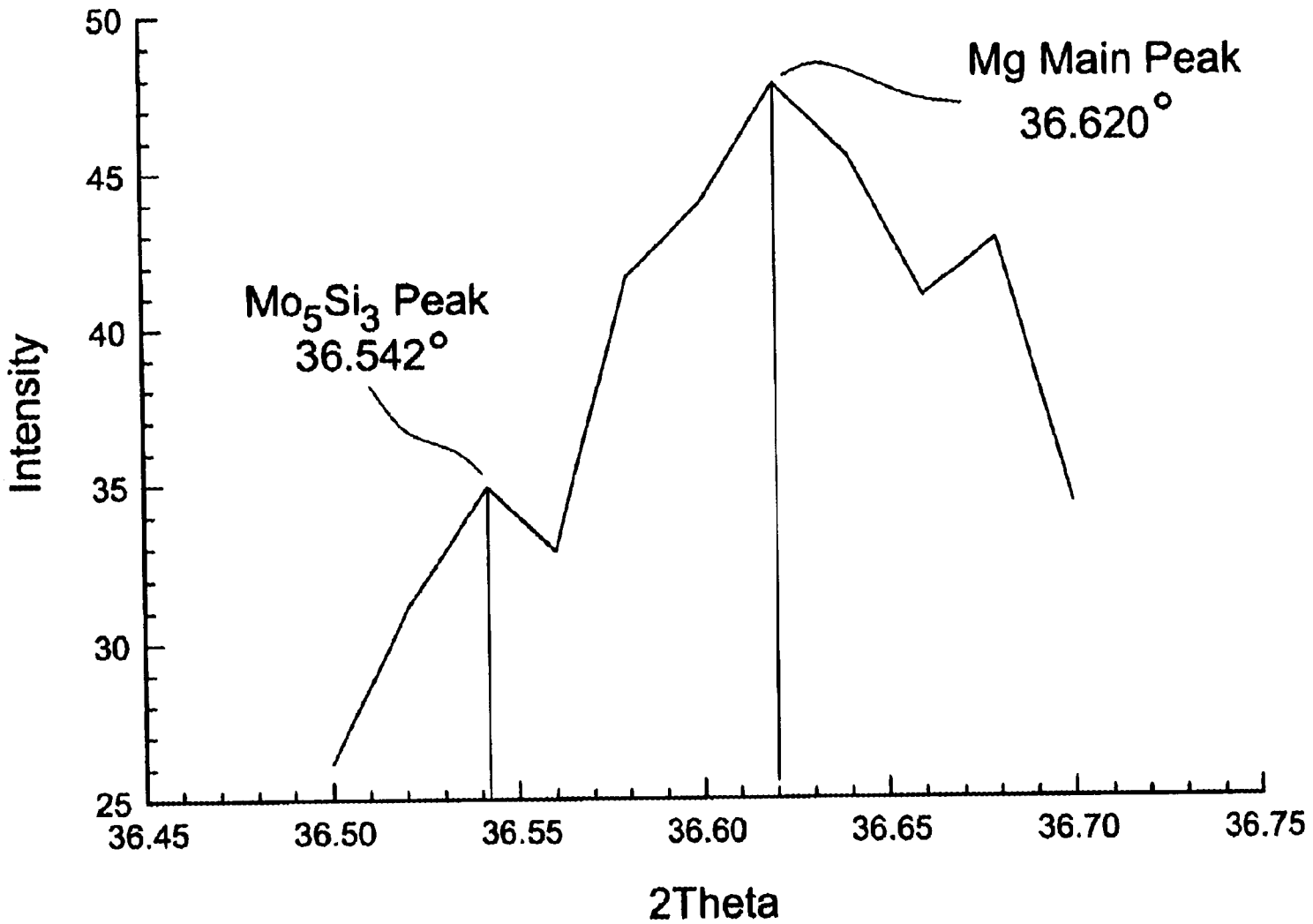
FIG. 5*c* is an expanded subrange of the FIG. 5*a*, taken at a slow scan and covering 2θ=36.5–36.7°.

FIG. 5*c*: mixed and subjected to SPS without mechanical activation, showing 2θ range of 36.5–36.7° (sub-range of FIG. 5*a*)

Figure 6A:
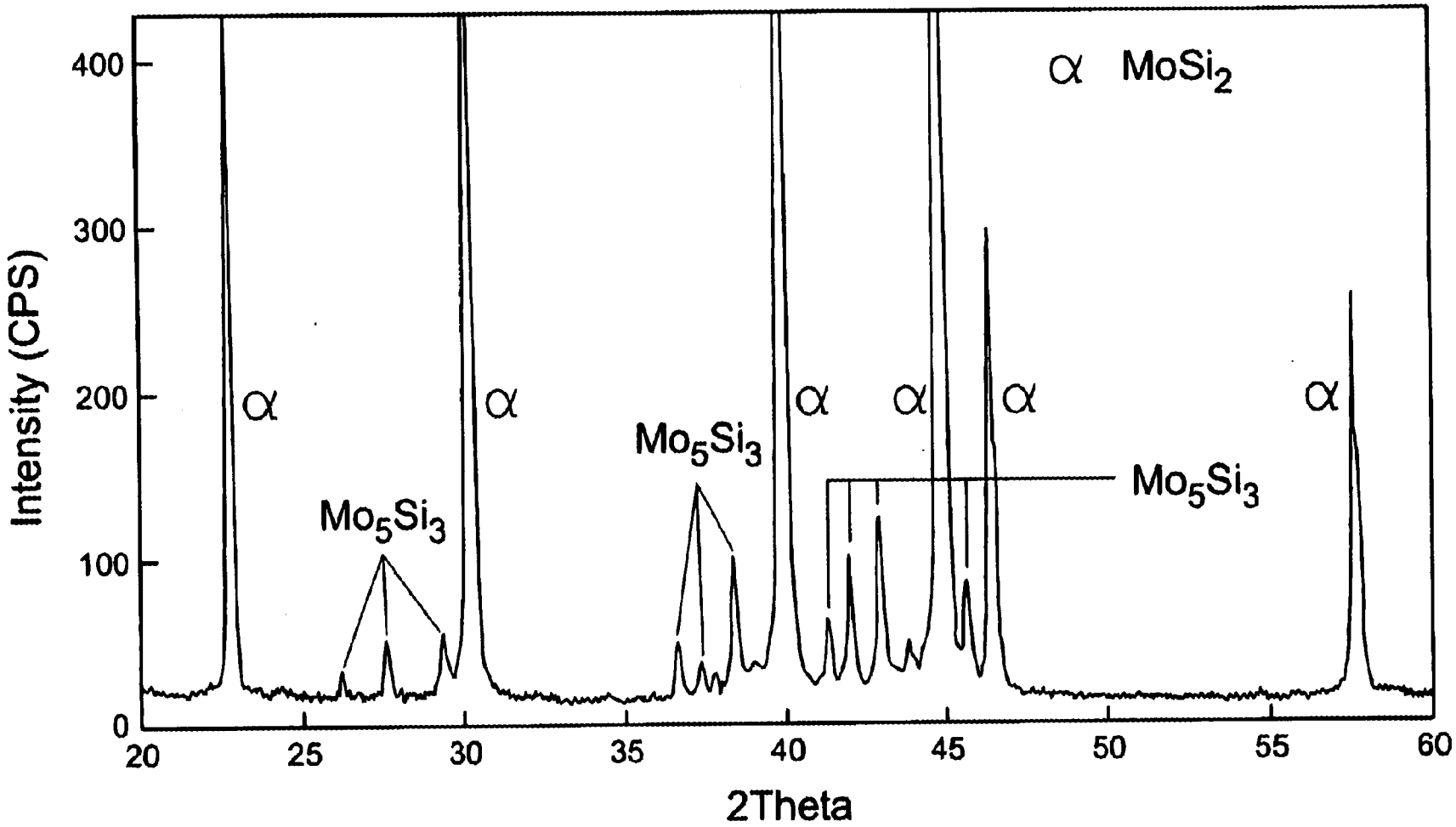
FIGS. 6*a* and 6*b*, illustrating an embodiment of the present invention, are 2θ=20–60° and 2θ=60–138° portions, respectively, of an x-ray diffraction pattern of a molybdenum, silicon, and magnesium powder mixture after both mechanical activation and SPS.

FIG. 6*a*: mixed, mechanically activated, and subjected to SPS, showing 2θ range of 20–60°

Figure 6B:
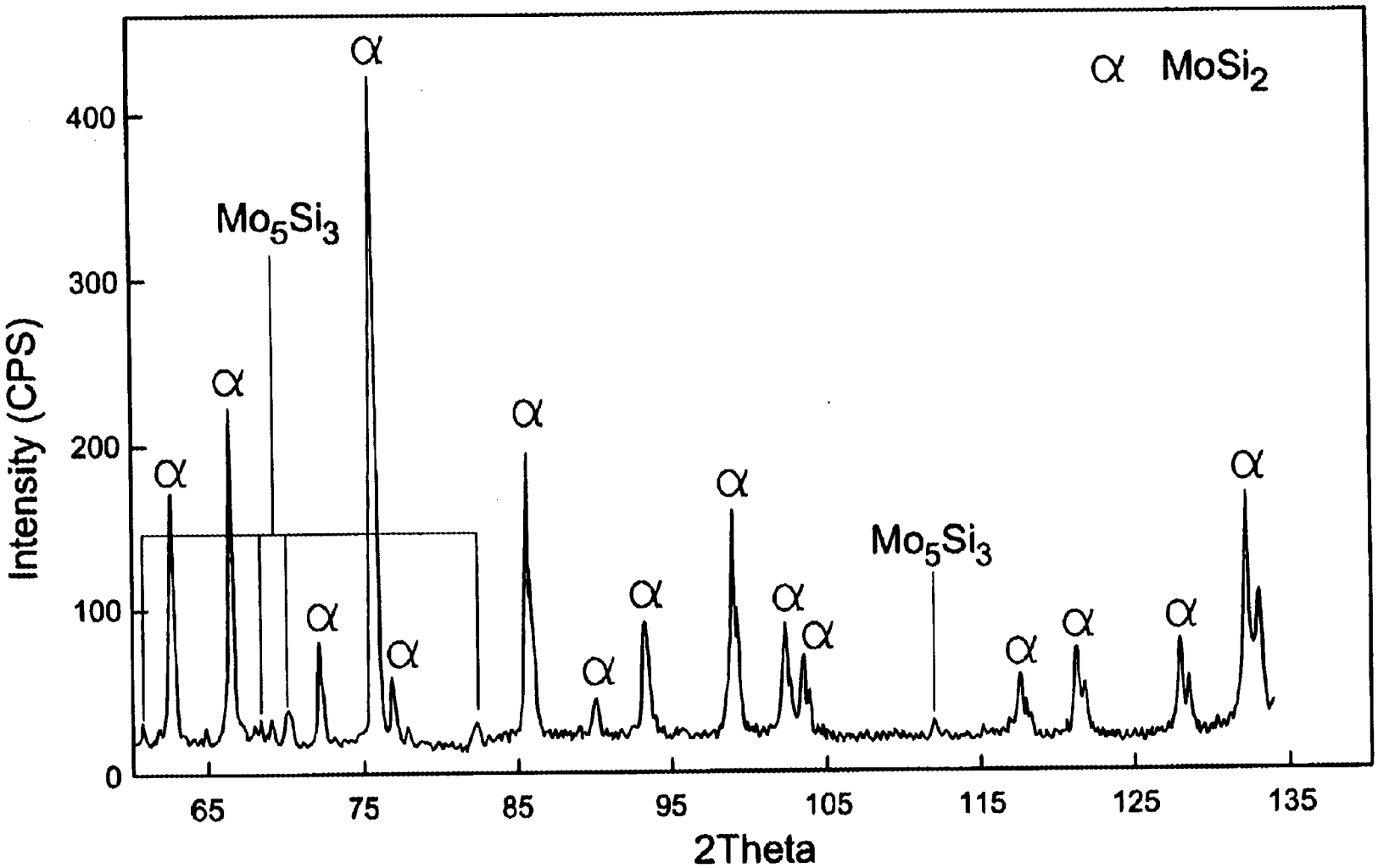

FIG. 6*b*: mixed, mechanically activated, and subjected to SPS, showing 2θ range of 60–138°

Figure 6C:
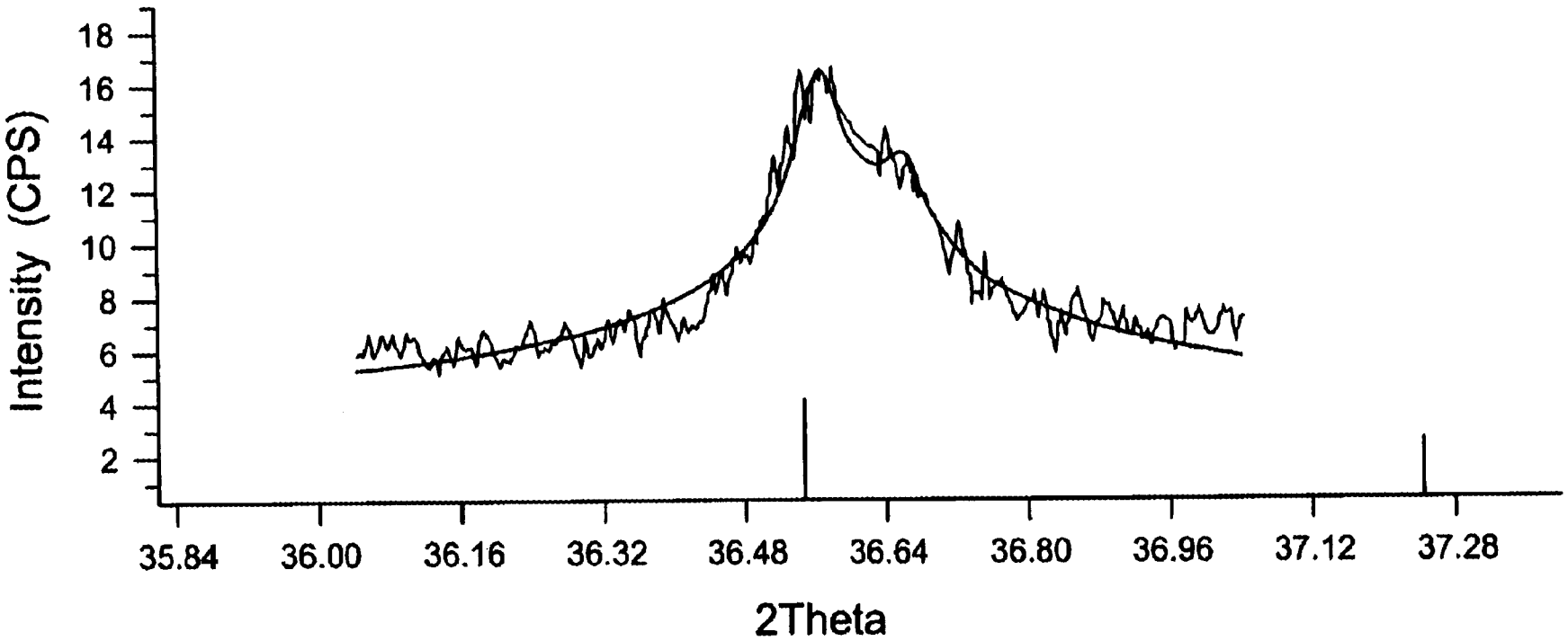
FIG. 6*c* is an expanded subrange of the FIG. 6*a*, taken at a slow scan and covering 2θ=36.04–37.04°.

FIG. 6*c*: mixed, mechanically activated, and subjected to SPS, showing 2θ range of 36.04–37.04° (sub-range of FIG. 6*a*)

The three most intense XRD peaks for magnesium occur at 2θ values of 36.620°, 34.399°, and 32.194°, and FIG. 3, representing the powder mixture with no treatment other than mixing, shows the presence of all magnesium peaks with the exception of those with very high angles and low intensity. Mechanical activation, as represented by FIG. 4, also result in the formation of $MoSi_2$ resulted in the beta phase (C40). The figure shows no evidence of the presence of free Mg, whose main peak is at a 2θ value of 36.620°, and instead shows only unreacted molybdenum and the high-temperature hexagonal (β) form of $MoSi_2$. Peak broadening for both the Mo and the product due to grain size reduction is also evident.

Turning next to the powders that had been subjected to SPS without mechanical activation, the XRD patterns of FIGS. 5*a* and 5*b* show the presence of free magnesium, α-$MoSi_2$, $Mo_5Si_3$, and unreacted Mo. The sub-range of FIG. 5*c* (36.5° to 36.7°) was run because the main peak of Mg (36.6200) is very close to one of the peaks for $Mo_5Si_3$ This sub-range was performed at a slow scan to separate the peaks, and FIG. 5*c* confirms the conclusion that free Mg and $Mo_5Si_3$ are both present.

In contrast, the XRD pattern of the sample that had been both mechanically activated and subjected to SPS (FIGS. 6*a* and 6*b*), show that free magnesium is absent in this sample, and α-$MoSi_2$ and $Mo_5Si_3$ are both present. The slow-scanned sub-range of FIG. 6*c* is included for the same reason as in the preceding paragraph, i.e., because the main peak of Mg (36.620°) is very close to one for $Mo_5Si_3$ FIG. 6*c* shows only the single $Mo_5Si_3$ peak, confirming that $Mo_5Si_3$ is present and free Mg is not.

Density Measurements

The densities of the reacted SPS samples (i.e., those that had been both mechanically activated and subjected to SPS) were determined volumetrically and by the Archimedes method. The relative density values (the measured densities divided by the theoretical value) obtained by these two methods, each representing average of seven samples, were 96.7% and 97.1%.

X-Ray and Scanning Electron Microscopy Analyses

Samples that had been subjected to SPS, either with or without prior mechanical activation, were sectioned by a high-speed diamond saw. A scanning electron microscopy analysis was performed on one half of each sample and an x-ray dot map was generated on the other half. The x-ray dot maps showed magnesium-rich regions in the samples that had not been mechanically activated while those of samples that had been mechanically activated showed that the magnesium was evenly distributed throughout the sample. These maps were then overlayed with the back-scattered electron (BSE) images, which revealed that in the non-mechanically activated samples the magnesium had segregated preferentially to the pores in the samples.

Energy Dispersive Spectroscopy (EDS) Analyses

For the samples that had been subjected to SPS but not mechanically activated, an image produced by EDS showed the presence of three phases, the first occupying a circular region in the center of the image, the second occupying a ring-shaped region encircling the first, and the third occupying the remainder of the image surrounding the first two phases. Quantitative chemical analyses were taken at six regions, the first four regions being in the outer (third) phase, and fifth region being in the intermediate ring-shaped phase, and the sixth region being in the inner phase. Quantitative elemental analyses taken within these regions are listed in Table I below.

TABLE I

Elemental Analyses by EDS (Atomic Percents)
Samples Subjected to SPS But Not Mechanically Activated

| | Outer Phase | | | | Middle | Inner |
|---|---|---|---|---|---|---|
| Element | Region 1 | Region 2 | Region 3 | Region 4 | Phase Region 5 | Phase Region 6 |
| Mg (K) | 0.08 | 0.12 | 0 | 0.03 | 0.32 | 0.84 |
| Si (K) | 63.83 | 60.24 | 64.56 | 63.71 | 37.55 | 1.97 |
| Mo (K) | 36.08 | 39.64 | 35.44 | 36.26 | 62.13 | 97.19 |
| Total | 100 | 100 | 100 | 100 | 100 | 100 |

These results show that Regions 1 through 4 (the outer phase) are $MoSi_2$, Region 5 (the intermediate phase) is $Mo_5Si_3$, and Region 6 (the inner phase) is unreacted molybdenum. The amounts of magnesium are insignificant and possibly represent the background signal.

For the samples that had been mechanically activated then subjected to SPS, an image produced by EDS showed two phases, a dispersed phase and an outer phase surrounding the dispersed phase. Quantitative chemical analyses taken at three regions, the first and second being in the outer phase, and third being in one of the dispersed areas. Quantitative elemental analyses of these regions are listed in Table II below.

TABLE II

Elemental Analyses by EDS (Atomic Percents)
Samples Mechanically Activated and Subjected to SPS

| | Outer Phase | | Inner Phase |
|---|---|---|---|
| Element | Region 1 | Region 2 | Region 3 |
| Mg (K) | 4.32 | 5.96 | 1.63 |
| Si (K) | 59.4 | 55.38 | 45.7 |
| Mo (K) | 36.28 | 38.66 | 52.67 |
| Total | 100 | 100 | 100 |

The results in Table II show that Regions 1 and 2 (the outer phase) are $MoSi_2$ and Region 3 (the inner phase) is $Mo_5Si_3$. Importantly, both phases contain Mg, with a larger amount in the $MoSi_2$ phase.

Electron Energy Loss Spectroscopy (EELS) Analyses

Figure 7:
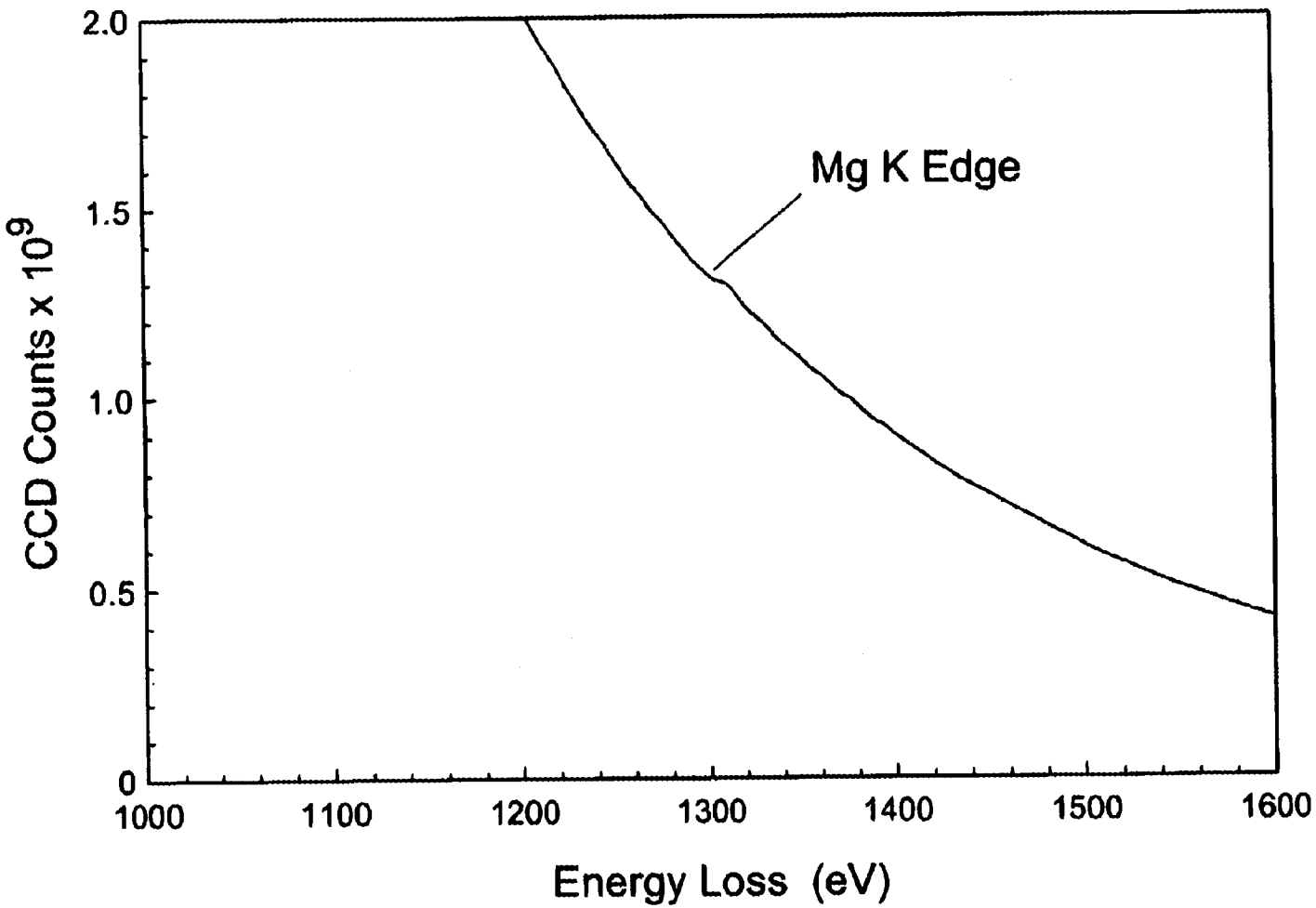
FIG. 7 is an electron energy loss spectrum taken on a sample treated in accordance with the present invention.
Figure 8:
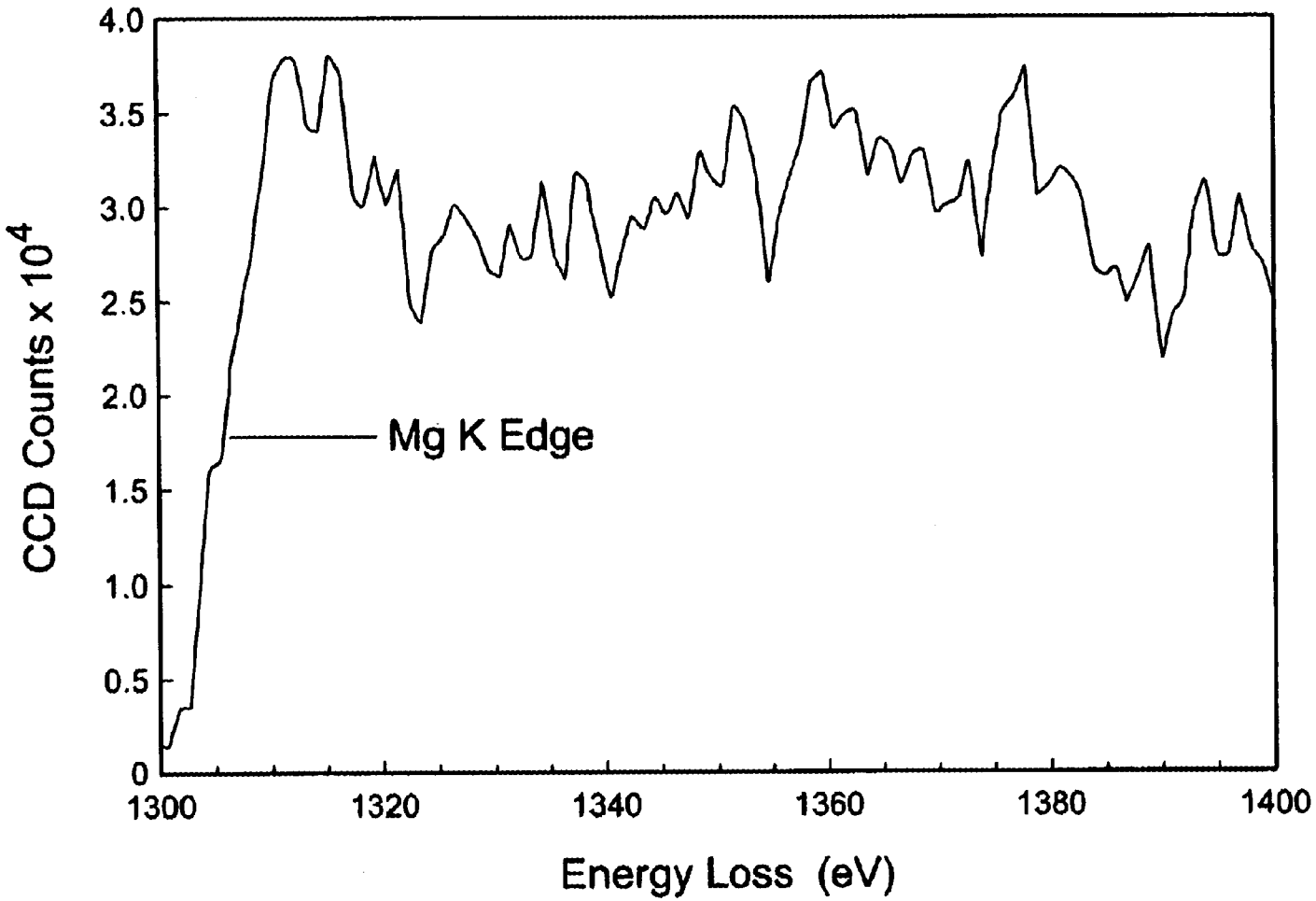
FIG. 8 is a portion of the spectrum of FIG. 7 with an expanded horizontal axis (energy loss in eV) and modified to remove background noise.

Electron energy loss spectra were taken on samples that had been both mechanically activated and subjected to SPS, and the results are shown in FIGS. 7 and 8. In FIG. 8, the background has been removed and the scale expanded to illustrate the magnesium edge. The presence of the magnesium edge indicates that magnesium has been successfully incorporated into the $MoSi_2$ lattice.

The foregoing is offered for purposes of illustration and explanation. Further variations, modifications and substitutions that, even though not disclosed herein, still fall within the scope of the invention may readily occur to those skilled in the art.

What is claimed is:

1. A method for the formation of an alloy of a transition metal silicide, said alloy having a fracture toughness that is greater than that of said transition metal silicide, said method comprising:

(a) forming a powder mixture of elemental components comprising said transition metal, silicon, and an alloying element that substitutes for either said transition metal or said silicon in a transition metal silicide crystal lattice;

(b) mechanically activating said powder mixture by milling at sufficient milling energy to cause incorporation of said alloying metal into a crystal structure containing said transition metal; and (c) reacting and densifying said mechanically activated powder mixture by compressing said mixture while passing an electric current through said mixture, thereby converting said mixture to a transition metal silicide crystal structure incorporating said alloying element.

2. A method in accordance with claim 1 in which said transition metal is a member selected from the group consisting of titanium, vanadium, chromium, yttrium, zirconium, niobium, molybdenum, tantalum, and tungsten.

3. A method in accordance with claim 1 in which said transition metal is a member selected from the group consisting of titanium, vanadium, chromium, niobium, molybdenum, and tantalum.

4. A method in accordance with claim 1 in which said transition metal is molybdenum.

5. A method in accordance with claim 1 in which said alloying element is an element that substitutes for silicon in said transition metal silicide crystal lattice.

6. A method in accordance with claim 5 in which said alloying element is a member selected from the group consisting of magnesium and aluminum.

7. A method in accordance with claim 5 in which said alloying element is magnesium.

8. A method in accordance with claim 1 in which said alloying element is an element that substitutes for said transition metal in said transition metal silicide crystal lattice.

9. A method in accordance with claim 8 in which said alloying element is a member selected from the group consisting of rhenium, niobium, tantalum, chromium, zirconium, and vanadium.

10. A method in accordance with claim 8 in which said alloying element is a member selected from the group consisting of rhenium, niobium, and vanadium.

11. A method in accordance with claim 1 in which said elemental components of step (a) comprise said transition metal, silicon, a first alloying element that substitutes for said transition metal in said transition metal silicide crystal lattice, and a second alloying element that substitutes for said silicon in said transition metal silicide crystal lattice.

12. A method in accordance with claim 11 in which said first alloying element is a member selected from the group consisting of magnesium and aluminum and said second alloying element is a member selected from the group consisting of rhenium, niobium, and vanadium.

13. A method in accordance with claim 1 in which said alloying element constitutes from about 0.5% to about 25% of said powder mixture of step (a) on an atomic basis.

14. A method in accordance with claim 1 in which said alloying element constitutes from about from about 1% to about 15% of said powder mixture of step (a) on an atomic basis.

15. A method in accordance with claim 1 in which said alloying element constitutes from-about from about 3% to about 10% of said powder mixture of step (a) on an atomic basis.

16. A method in accordance with claim 1 in which said alloying element is an element that substitutes for silicon in said transition metal silicide crystal lattice, and step (a) comprises combining said alloying element, said transition metal, and said silicon in amounts selected to produce a powder mixture with an atomic ratio of (i) said alloying element and silicon to (ii) transition metal of from about 1.9:1 to about 2.1:1, and in which said alloying element constitutes from about 1% to about 15% of said powder mixture.

17. A method in accordance with claim 1 in which said alloying element is magnesium, and step (a) comprises combining said magnesium, said transition metal, and said silicon in amounts selected to produce a powder mixture with an atomic ratio of (i) magnesium and silicon to (ii) transition metal of from about 1.95:1 to about 2.05: 1, and in which said magnesium constitutes from about 3% to about 10% of said powder mixture.

18. A method in accordance with claim 1 in which step (b) comprises milling said powder mixture in a planetary mill.

19. A method in accordance with claim 18 in which step (b) comprises operating said planetary mill at a charge ratio of from about 10 to about 20.

20. A method in accordance with claim 18 in which said transition metal is molybdenum and step (b) comprises operating said planetary mill at a charge ratio of from about 12 to about 16.

21. A method in accordance with claim 1 in which step (c) comprises applying to said mechanically activated powder mixture a densification pressure of from about 10 MPa to about 200 MPa and a pulsed direct current of from about 1,000 A to about 10,000 A at a temperature of from about 900° C. to about 2,000° C.

22. A method in accordance with claim 1 in which said transition metal is molybdenum and in which step (c) comprises applying to said mechanically activated powder mixture a densification pressure of from about 40 MPa to about 100 MPa and a pulsed direct current of from about 1,500 A to about 5,000 A at a temperature of from about 1,000° C. to about 1,500° C.

23. An alloy of magnesium and a transition metal silicide prepared by the method of claim 16.

24. An alloy of magnesium and a transition metal silicide prepared by the method of claim 17.

* * * * *